United States Patent [19]

Benting

[11] Patent Number: 4,486,106

[45] Date of Patent: Dec. 4, 1984

[54] ROTARY SHELF ASSEMBLY

[75] Inventor: Gary M. Benting, Rockford, Ill.

[73] Assignee: Amerock Corporation, Rockford, Ill.

[21] Appl. No.: 496,302

[22] Filed: May 19, 1983

[51] Int. Cl.[3] ..... F16C 23/02

[52] U.S. Cl. ..... 384/248; 384/242; 312/305

[58] Field of Search ..... 384/248, 242, 226, 247, 384/258, 259, 243; 312/305, 125, 197

[56] References Cited

U.S. PATENT DOCUMENTS

| | | | |
|---|---|---|---|
| 1,721,363 | 7/1929 | Wesp | 384/248 |
| 3,266,857 | 8/1966 | Anderson | 312/252 |
| 3,281,197 | 10/1966 | Anderson | 312/305 |
| 4,181,037 | 1/1980 | Boon et al. | 312/305 |
| 4,433,885 | 2/1984 | Baker | 312/305 |

OTHER PUBLICATIONS

Leslie Metal Arts Co., Inc., Installation Instructions of 8-81.

*Primary Examiner*—Lenard A. Footland

*Attorney, Agent, or Firm*—Leydig, Voit, Osann, Mayer & Holt, Ltd.

[57] ABSTRACT

A rotary shelf assembly having a plurality of shelves mounted on a vertical post is disposed in a cabinet frame with upper and lower bearing elements supported at opposite ends of the post and coacting with vertically spaced bearing members which are secured to the cabinet frame to support the post for turning about its longitudinal axis. The assembly is adapted to be mounted in the corner of the cabinet frame and, to accommodate this, the shelves have perpendicular edges which generally aline with the sides of the cabinet in one angular position of the post and which support a V-shaped door. To adjust the vertical position in the cabinet frame, the lower bearing element is on a slide in the lower end portion of the post and a manual actuator on the post moves a cam which cooperates with a cam follower on the slide to move the slide and hence the lower bearing member downwardly relative to the post.

9 Claims, 7 Drawing Figures

ROTARY SHELF ASSEMBLY

BACKGROUND OF THE INVENTION

This invention relates to a rotary shelf assembly which includes a rotatable vertical post supporting a plurality of shelves. More particularly, the invention relates to such an assembly which is adapted to be mounted in the corner of a cabinet frame and, to this end, each shelf is circular except for a section the edges of which are perpendicular to each other and which, in one angular position of the post, are alined with the sides of the cabinet frame at the corner of the latter. A V-shaped door is secured to these edges so that the door turns with the post and the shelves to present the shelves to an opening in the frame. To support the post for turning, upper and lower bearing elements carried at the ends of the post cooperate with upper and lower bearing members which are vertically alined and are secured to the cabinet frame.

Such assemblies usually are assembled at a factory or a shop and installed in the cabinet in that condition. Accordingly, the assemblies include means to adjust the vertical spacing of the bearing elements to accommodate the vertical spacing of the bearing members in each individual cabinet.

SUMMARY OF THE INVENTION

The general object of the invention is to provide a rotary shelf assembly with a new and improved means for adjusting the bearing elements so that the adjustment may be made easily either during or after the installation of the assembly while the overall construction of the assembly remains comparatively simple and inexpensive.

A more detailed object is to achieve the foregoing by mounting the lower bearing element on a slide which is disposed in the lower end portion of the post for endwise movement and the slide is moved down relative to the post by a cam which is disposed within the post and coacts with a cam follower on the slide, the cam being moved along the follower by a manual actuator mounted on the post.

Another object is to form the cam follower as a surface disposed on the upper end of the slide and inclined to the horizontal and to form the cam as a block which is movable transversely in the post by the actuator and which has a downwardly facing surface complemental to and engaging the cam follower surface.

The invention also resides in the novel construction and cooperation of the particular components of the shelf assembly.

DETAILED DESCRIPTION OF THE PREFERRED EMBODIMENT

Figure 2:
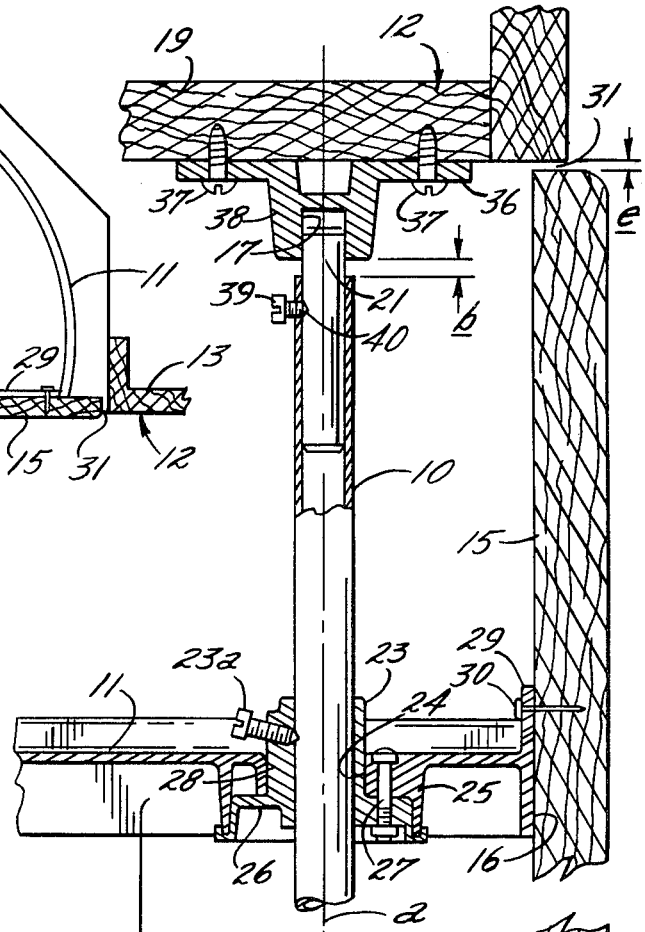
FIG. 2 is an enlarged fragmentary sectional view taken along the line 2—2 in FIG. 1.

Although the invention is applicable to a wide variety of applications, it is shown in the drawings for purposes of illustation as embodied in an assembly including a hollow tubular vertical post 10 rotatable about its longitudinal axis a (FIG. 2) and supporting one or more shelves 11 in the frame 12 of a cabinet. The shelves are mounted in a corner of the cabinet as defined by perpendicular walls 13 and 14 and a door 15 associated with the assembly is V-shaped so that each half alines with one of the walls when the door is closed. Each shelf is circular except for a sector which has perpendicular edges 16 to accommodate the door and the shelf is centered about the axis a.

The post 10 is disposed between and alined with upper and lower bearing members 17 and 18 secured respectively to parts 19 and 20 of the cabinet frame 12 and the bearing members coact respectively with bearing elements 21 and 22 on the upper and lower ends of the post to journal the ends of the post for free rotation about the axis a. Each shelf 11 is mounted on the post to turn with the latter by means of a collar 23 which encircles the post and the collar is fastened at the desired location on the post by a set screw 23*a* threaded through the collar and bearing against the post. The bore 24 of a central cylindrical hub 25 on the underside of the shelf fits snugly on the collar and rests on a radial flange 26 formed on the latter, the hub and the flange being clamped together by bolts 27. An enlargement 28 on the side of the collar is received in a complementally shaped part of the bore 24 to fix the angular relationship of the collar and the shelf. The door 15 abuts flanges 29 along the edges 16 of the shelves and is secured to these flanges as by nails 30. Thus, the shelves and the door are in a fixed position on the post and turn bodily with the post. When the post is angularly positioned to place the door in the closed position with its halves alined with the cabinet walls 13 and 14, the door is positioned in the access opening 31 (FIG. 2) in the cabinet frame 12. When the shelf assembly is turned about the axis a as permitted by the rotatable mounting of the post 10, successive portions of the shelves are presented to the access opening.

The vertical distance between the upper and lower bearing members 17 and 18 varies from one cabinet to another due to such factors as the tolerances used in making the cabinets. Because the shelves 11 usually are assembled on the post 10 at a factory or a shop, it often is necessary to adjust the bearing elements 21 and 22 relative to the bearing members during installation so that the bearing members and elements are in firm but freely rotating engagement with each other. The present invention contemplates the provision of a novel assembly which is readily and easily adjustable both during and after installation of the assembly to accommodate individual variations in the distance between the bearing members. To this end, the bearing element 22 is mounted on a slide 32 which is disposed within the post 10 near the lower end thereof and is slidable axially in the post and a cam 33 inside the post engages a cam follower 34 on the slide to selectively move the slide and hence the bearing element 22 axially of the post.

The cam is moved transversely of the post to move the slide by means of a manual actuator 35 mounted on the post and engaging the cam. With this arrangement, the post is simply rotated to a position where the actuator is easily accessible to make an adjustment.

Herein, the upper bearing member 17 is a downwardly opening socket and is on a circular plate 36 secured to cabinet frame part 19 by screws 37 and having a central boss 38 which defines the socket. The latter receives the upper bearing element 21 which is a trunnion in the form of a molded plastic cylinder received in the upper end portion of the post 10 and projecting out of the upper end of the post and into the socket. The cylinder is adjustably held in place in the post by a set screw 39 which is threaded through a hole 40 in the wall of the post and bites into the side of the cylinder. In the form shown in the drawings, the lower bearing member 22 is a cylindrical trunnion upstanding from a rectangular plate 41 which is secured to the frame part 20 by screws 42. The lower bearing element 22 is a socket formed in the outer end of the slide 32 to receive the trunnion 18. The trunnions 18 and 21 and the sockets 22 and 17 are alined along the axis a of the post and define the axis of rotation of the post.

Figure 3:
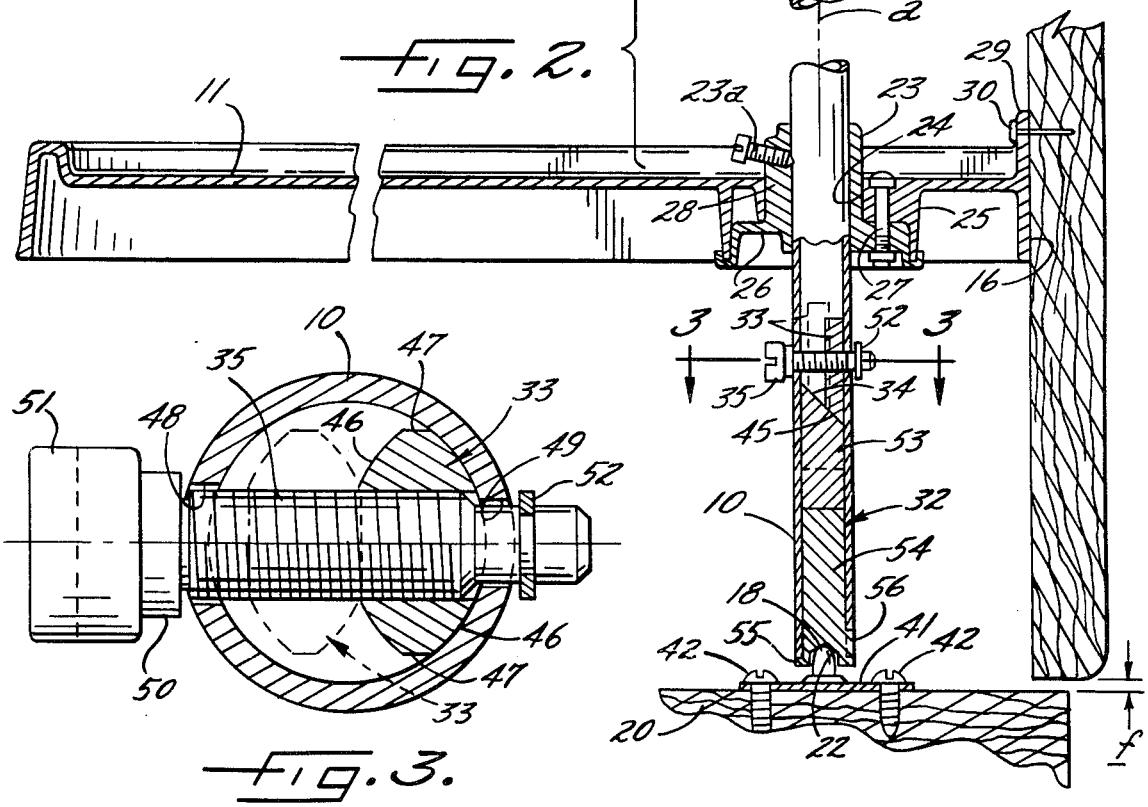
FIG. 3 is an enlarged sectional view taken along the line 3—3 in FIG. 2.

In the preferred embodiment, the cam follower 34 is a flat surface on the upper end of the slide 32 and inclined relative to the horizontal and to the axis a, herein at an angle of about 45 degrees to the axis, so as to have a higher side 43 (FIG. 4) and a lower side 44. The cam 33 is an upright block smaller in cross section than the interior of the post and disposed above the slide. The lower end of the block is inclined to provide a surface 45 which is complemental to and engages the cam surface 34. In cross section, the thickness of the block 33 in the direction that the surface 34 is inclined is less than half the internal diameter of the post 10 (see FIG. 3). The sides 46 of the block are arcuate with the same radius as the inner wall of the post and the edges 47 of the block are flat.

The actuator 35 holds the cam block 33 against endwise movement longitudinally of the post 10 while traversing the block horizontally in the post. Herein, the actuator is a horizontal screw projecting through diametrically opposed holes 48 and 49 (FIGS. 3 and 4) and is threaded through the cam block. The screw is held against axial movement by a shoulder 50 under the head 51 of the screw and by a snap ring 52 received on the end of the screw. Thus, when the screw is turned, the block moves along the screw transversely of the post. As the block moves away from the lower side 44 of the cam surface 34, it cams the slide 32 endwise relative to the post and projects the slide outwardly through the lower end of the post. Because the socket 22 in the slide usually is resting on the trunnion 18, the slide cannot move down and, as a result, the block rides up on the cam surface as shown in broken lines in FIG. 2 and, through the screw acting on the upper edges of the holes 48 and 49, lifts the post.

Figure 4:
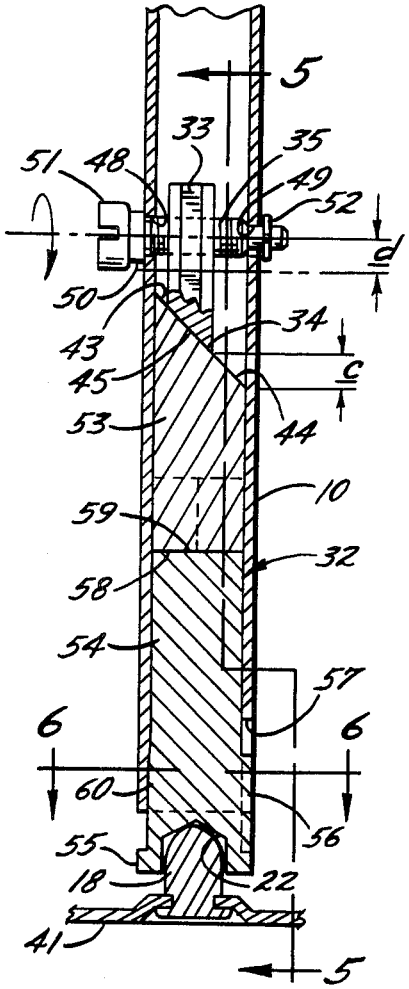
FIG. 4 is an enlarged fragmentary sectional view similar to FIG. 2 but showing the parts in a moved position.
Figure 7:
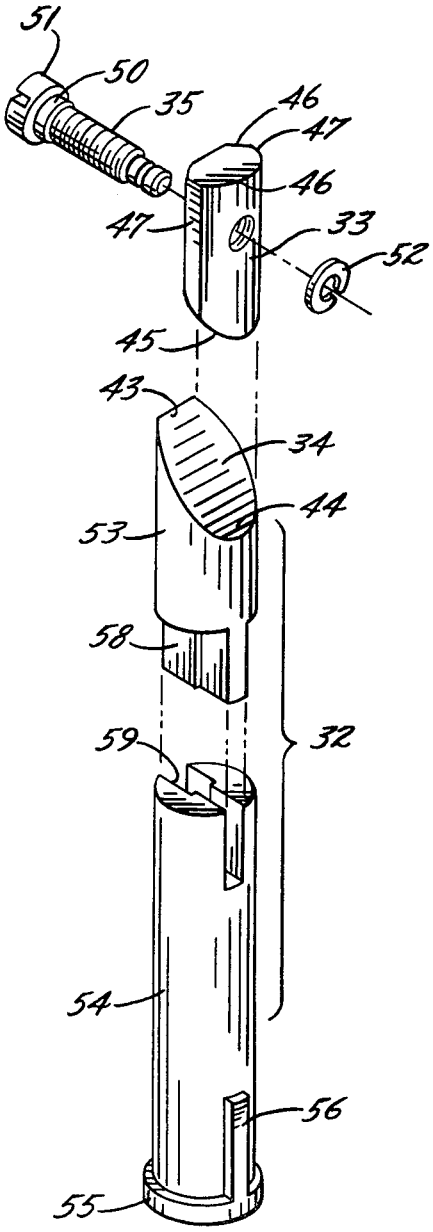
FIG. 7 is an exploded perspective view of the slide, the cam and the manual actuator.

It is desirable to have the socket 22 made of a bearing material and, at the same time, to have the cam surface 34 be smooth, hard and wear-resistant. To this end, the slide 32 herein is made in two parts 53 and 54 with the lower part being made of a molded plastic material and the upper part being made of a sintered metal such as iron. An annular flange 55 at the lower end of the part 54 abuts and limits the downward movement of the post 10 on the slide 32 as shown in FIG. 4. A longitudinal key 56 (FIG. 5) extends upwardly from the flange and is received in a vertical slot 57 in the lower end portion of the post to prevent the slide from turning in the post and to maintain the desired orientation of the post and the slide. The parts 53 and 54 are held together against relative rotation by a tongue 58 depending from the part 53 and received in an upwardly opening groove 59 in the upper portion of the part 54 (FIG. 7). The tongue extends diametrically across the part 53 and is T-shaped in cross section and the groove similarly extends diametrically across the part 54 and is of complemental T-shape. Diametrically opposite the key 56 is a small vertical rib 60, exaggerated in size in FIG. 6, which makes a force fit with the post and prevents the post from rattling on the slide.

Figure 1:
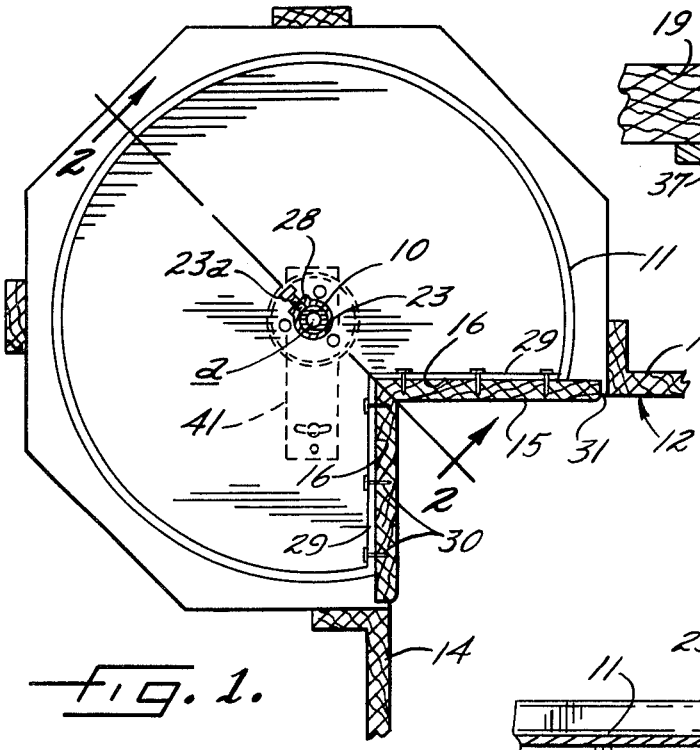
FIG. 1 is a top plan view of a cabinet assembly embodying the present invention and shown mounted in a cabinet frame.

The hole 40 for the set screw 39 is vertically alined with the hole 48 for the screw 35 and are diametrically opposite the center of the door 15 as shown in FIG. 1. As a result, when the shelf assembly including the door is turned through about 180 degrees, the heads of both of these screws face the opening 31 in the cabinet frame 12. Accordingly, the screws are readily accessible to effect an adjustment of the post 10 on the slide 32 and of the trunnion 21 in the bearing member.

Figure 5:
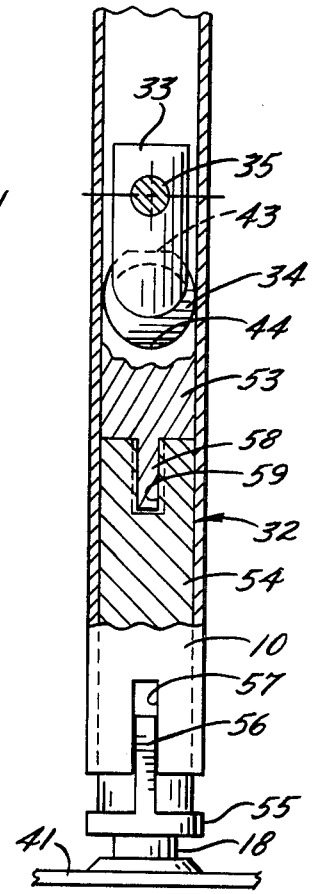
FIG. 5 is a fragmentary sectional view taken along the line 5—5 in FIG. 4.
Figure 6:
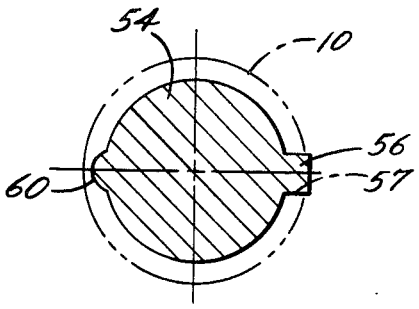
FIG. 6 is an enlarged sectional view taken along the line 6—6 in FIG. 4.

With the foregoing arrangement, the shelf assembly is installed by first securing the bearing plates 36 and 41 to the cabinet frame parts 19 and 20 respectively with the socket 17 and the trunnion 18 alined vertically. With the trunnion 21 projecting beyond the upper end of the post 10 and held by the set screw 39, the post with the shelves 11 attached is oriented in the cabinet frame with the socket 22 in the slide 32 resting on the trunnion 18 and the trunnion 21 projecting into the socket 17. This leaves a vertical distance b (FIG. 1) through which the post and hence the shelves and the door may be adjusted. The vertical location of the door 15 in the opening 31 and the amount the door should be raised are noted and the post is turned to place the door inside the cabinet frame with the screws 35 and 39 exposed at the opening. At this time, the post usually is resting on the flange 55 and the cam block 33 is at the lower side 44 of the cam surface 34 as shown in solid lines in FIG. 2. The screw 35 is then turned clockwise as indicated by the arrow in FIG. 4 so that the cam block 33 travels along the screw. Because the slide 32 cannot move downwardly, the cam block slides up on the cam surface 34 as illustrated, for example, in broken lines in FIG. 2. This raises the post on the slide as shown in FIGS. 4 and 5. The screw 35 is turned until the post and hence the door have been raised the desired amount. For example, the screw is turned until the cam block has been elevated a distance c (FIG. 4) so that the screw lifts the post and hence the door an equal distance d until the spaces e and f (FIG. 2) above and below the door are approximately equal.

I claim:

1. A rotatable post assembly comprising, first and second bearing members spaced apart and opposing each other, a tubular post disposed lengthwise between said members with first and second ends of the post spaced from and opposing respectively said first and second members, a first bearing element mounted on said post adjacent said first end and operable to engage said first bearing member and journal said first end for rotation about the axis of said post, a slide disposed in said post adjacent said second end thereof to move axially of the post and having a second bearing element projecting axially outwardly of said second end, said second bearing element being operable to engage said second bearing member to journal said second end of said post, a cam follower on said slide, a cam disposed in said post and engaging said cam follower, said cam being movable transversely of said post and operable when moved in one direction to cam said slide axially and outwardly of the post to cause said bearing elements to firmly engage the respective bearing members, and a manual operator mounted on said post and connected to said cam to move the cam transversely of the post.

2. A rotatable post assembly comprising, first and second bearing members spaced apart and opposing each other, a tubular post disposed lengthwise between said members with first and second ends of the post spaced from and opposing respectively said first and second members, a first bearing element mounted on said post adjacent said first end and operable to engage said first bearing member and journal said first end for rotation about the axis of said post, a slide disposed in said post adjacent said second end thereof to move axially of the post and having a second bearing element projecting axially outwardly of said second end, said second bearing element being operable to engage said second bearing member to journal said second end of said post, a flat cam surface formed on the inner end of said slide and inclined relative to the axis of said post, a cam disposed in said post inwardly of said slide and having a surface opposing and engaging said cam surface, means for holding said slide against turning relative to said post, an actuating screw projecting transversely through said post and threaded through said cam, and means to hold said screw against endwise movement whereby turning the screw in one direction causes said cam to move transversely of said post and cam said slide axially and outwardly of the post thereby to cause said bearing elements to firmly engage the respective bearing members.

3. A rotatable post assembly as defined in claim 2 in which said slide is composed of an inner part made of metal and defining said cam surface and of an outer part made of a molded plastic and defines said second bearing element, and means connecting said parts to slide together in said post.

4. A rotatable post assembly as defined in claim 2 in which said actuating screw has a head at one end and disposed outside said post, said first bearing element including a cylinder adjustably slidable in said post, and a set screw threaded through said post and bearing against said cylinder to hold the latter in place, said set screw having a head alined with the head on said actuating screw.

5. A rotatable post assembly comprising, an upper bearing member having a first downwardly opening cylindrical socket, a second bearing member having a first trunnion projecting upwardly and alined with but spaced from said socket, a hollow vertical post disposed between but spaced from said bearing members and alined with said socket and said trunnion, a second trunnion rigid with said post and projecting beyond the upper end thereof and into said first socket to journal the upper end of the post, a slide disposed in the lower end portion of said post for endwise sliding in the latter, means preventing said slide from turning relative to said post, the lower end of said slide having a second downwardly facing socket receiving said first trunnion to journal the lower end of said post, a flat cam surface formed on the upper end of said slide and inclined relative to the axis of said post to have a lower side and a higher side, a cam disposed in said post above said slide and being smaller in cross section than the slide, the lower surface of said cam engaging and being complemental with said cam surface, an elongated actuator projecting through opposite sides of said post and treaded through said cam, and means to hold said actuator against endwise movement whereby turning the actuator in one direction moves the cam transversely of the post and moves the slide outwardly so that each of said trunnions is received firmly in the associated socket.

6. A rotatable post assembly as defined in claim 5 in which said slide comprises an upper part made of metal and defining said cam surface and a lower part made of molded plastic and defining said second socket, and means connecting said parts to slide together in said post.

7. A rotatable post assembly as defined in claim 6 including an elongated rib formed integrally with said lower part and extending longitudinally along the side of the lower part, said rib having a force fit with said post.

8. A rotatable post assembly as defined in claim 5 in which the means for preventing the slide from turning in the post is a longitudinal slot formed in the lower end portion of said post and a longitudinal key slidable in said slot and molded integrally with said lower part.

9. A rotatable post assembly as defined in claim 8 including an annular flange molded integrally around the lower end of said lower part to abut the lower end of said post and limit downward movement of the post relative to said slide.

* * * * *